United States Patent [19]

Garrett

[11] 4,018,207

[45] Apr. 19, 1977

[54] DEVICE FOR DRESSING GRINDING WHEELS

[75] Inventor: Wayne O. Garrett, Amelia, Ohio

[73] Assignee: William Berry, Cincinnati, Ohio

[22] Filed: Oct. 14, 1975

[21] Appl. No.: 622,152

[52] U.S. Cl. ..... 125/11 B

[51] Int. Cl.[2] ..... B24B 53/04

[58] Field of Search ..... 125/11 R, 11 AT, 11 B, 125/11 BS; 51/DIG. 31

[56] References Cited

UNITED STATES PATENTS

| | | | |
|---|---|---|---|
| 1,369,789 | 3/1921 | Dawson | 125/11 B |
| 2,585,305 | 2/1952 | Fritts | 125/11 AT |
| 3,187,737 | 6/1965 | Oscar | 125/11 R |
| 3,576,184 | 4/1971 | Nichols | 125/11 B |

*Primary Examiner*—Harold D. Whitehead
*Attorney, Agent, or Firm*—Wood, Herron & Evans

[57] ABSTRACT

A device for dressing a grinding wheel to a desired precise angle. The device includes a body, preferably in the form of a rectangular block, presenting mutually perpendicular mounting faces. A spindle is journaled in the body for rotation about an axis parallel to the mounting faces. A head is mounted to the spindle at one end of the body block, for rotation with it. Angulation of the spindle is settable by a sine bar at the opposite end of the body. The dressing tip is carried by a slide that is reciprocable on the head, the slide being reciprocated by a crank mechanism turned by an operating shaft coaxial to the spindle. The slide can be set in either of two positions 180° apart for dressing oppositely facing bevels.

9 Claims, 5 Drawing Figures

DEVICE FOR DRESSING GRINDING WHEELS

Figure 1:
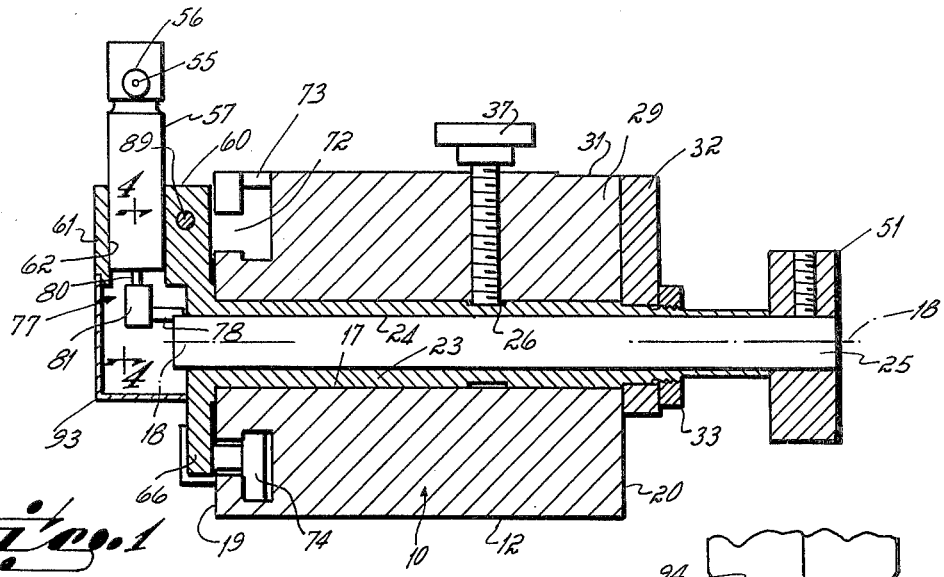

This invention relates to a device for dressing a grinding wheel to an accurate angle. Many of the types of grinding wheels in widespread use, for example those used in grinding threads, have a bevel edge on each face, the bevels facing oppositely and meeting at a central plane. These bevels must often be precisely angulated, to insure that the threads will be ground to desired accuracy. The angulation of the bevels on each side may or may not be the same. In production grinding, these wheels require truing or dressing repetitively.

In the dressing operation, a diamond tip is moved slowly across the bevel face at the desired angle, to dress it. The tip must be positioned to move smoothly on a lineal path without deflection; and it may be reciprocated several times along that path to insure that the wheel is accurately dressed.

There has been a need for a wheel dressing device which can be set accurately by a sine bar to cut desired angles and which can rapidly be set to dress two oppositely facing bevels on a wheel, without laborious resetting on the opposite side of center. This invention answers this need, and at the same time provides a dressing device which can quickly be mounted to a magnetic chuck in a variety of precise predetermined orientations to present the tool in a number of accurately known positions for cutting not only predetermined angles on opposite faces of a wheel, but also their complements.

In accordance with a preferred embodiment of the invention, the device includes a body in the form of a rectangular block presenting mutually perpendicular mounting faces. A spindle is journaled in the body for rotation about a longitudinal axis parallel to the mounting faces. An angulatable head is mounted to the spindle at one end of the body block for rotation with the spindle, and is supported facially against the end of the body so that its deflection is minimal under load. The angulation of the spindle is settable by a sine bar at the opposite end of the body, remote from the dressing tip. Gauge blocks can be seated on a platform projecting from the body end face, to position a sine plate connected to the spindle. The platform is easily removable from the body so that it can be used to set an angle on one side of center, then removed to provide clearance for the sine plate to be turned so that an angle can be set on the other side of center.

The dressing tip is carried by a slide that is operated by a crank mechanism, turned by an operating shaft that is journaled coaxially within the spindle. A knob for operating this shaft is adjacent to the sine bar mechanism, and remote from the dressing tip. The slide can be set in either of two positions 180° apart, to face on opposite sides of center for dressing oppositely facing bevels. When the knob is rotated unidirectionally, the slide is reciprocated with respect to the head, the tip defining a line at a fixed angle with respect to the mounting faces. Stops are provided by which, once the desired angles have been set on the respective side of center, the device can repetitively be set at either of the two angles without use of the sine bar mechanism.

Figure 2:
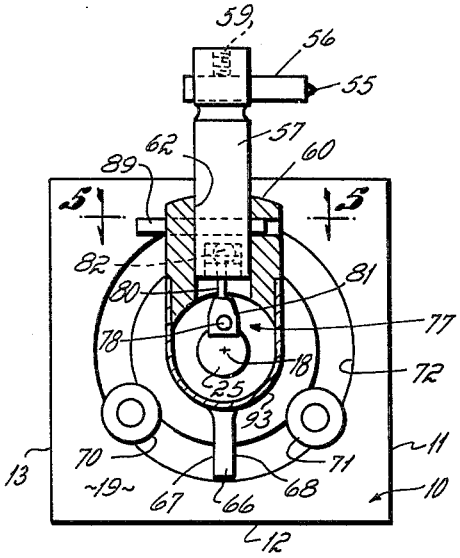
Figure 3:
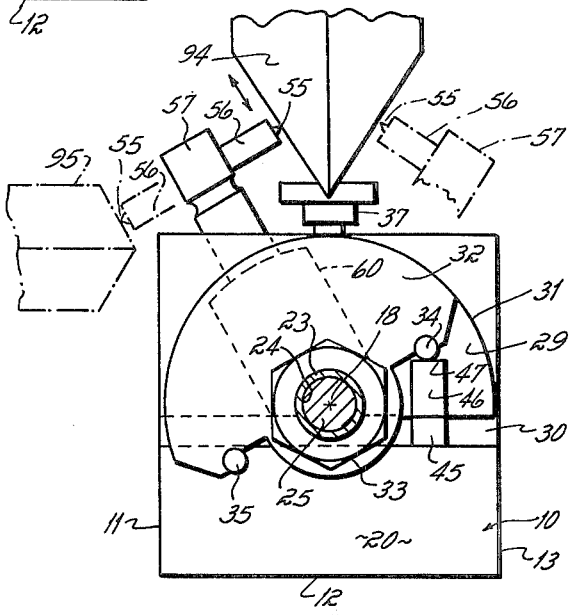
Figure 4:
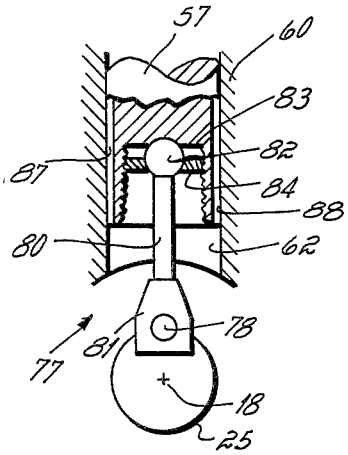
Figure 5:
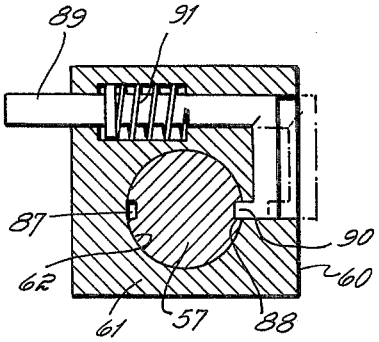

The invention can best be further described by reference to the accompanying drawings, in which:

FIG. 1 is a vertical axial section through a device in accordance with a preferred embodiment of the invention, FIG. 2 is an elevation, partly cut away, of one end of the device shown in FIG. 1, showing the angulatable head and the crank mechanism for reciprocating the slide which mounts the dressing tool carrier, FIG. 3 is an elevation of the opposite end of the device from that shown in FIG. 2, showing the sine bar mechanism for precisely setting the angulation of the head, FIG. 4 is an enlarged fragmentary cross-sectional view taken on line 4—4 of FIG. 1, showing the crank mechanism for reciprocating the dressing tool, and FIG. 5 is an enlarged cross-sectional view taken on line 5—5 of FIG. 2, showing the means for reversing the orientation of the dressing tip carrier with respect to the slide.

The preferred embodiment of the invention, shown in the drawings by way of exemplification, includes a body 10 in the form of rectangular block. Body 10 has at least two, and preferably three, planar mounting faces at right angles to one another, all accurately ground to flatness. In the embodiment illustrated, the block has three mounting faces, 11, 12 and 13, faces 11 and 13 being on opposite sides of the body 10, and both extending perpendicularly to the base face 12. In use, the body can be mounted on whichever face is most convenient for a given operation, for example by seating it on a magnetic chuck which attracts the adjacent face 11, 12 or 13. (As will be seen, no portion of the device necessarily projects beyond the plane of the particular mounting face in use.) The advantage of these alternative mounts is that once the tool has been set at a desired angle, the device can be used to obtain not only that angle, but also the angle which is the complement of it, simply by remounting the body on another face, perpendicular to the first. For example, when the dressing tip is set to provide a given bevel angle, say 60°, when seated on face 12, it can be used to obtain the complement of the set angle, e.g., 30°, by shifting it from base 12 to base 11 or 13 (see FIG. 3).

Body 10 has a through bore 17, the axis 18 of which extends parallel to the mounting faces 11, 12 and 13, andperpendicular to body end faces 19 and 20. A sleeve or spindle 23 is rotatably journaled in bore 17 and itself presents a through bore 24, which in turn journals a rotatable operating shaft 25. Spindle 23 can be secured in a desired angular or rotational position with respect to body 10 by a thumb screw 37, threaded in body 10 and having an inner end which can be tightened against a groove 26 around spindle 23.

End face 20 of body 10 (the right end face as viewed in FIG. 1) includes a semicircular upper portion 29 and a groove 30 that runs centrally across face 20, parallel to the base 12. The semicircular peripheral edge 31 of end face upper portion 29 is an arc centered about axis 18. A scale graduated in degrees on either side of vertical is provided on this edge 31, as an approximate visual indication of the angle to which the dressing tip is set.

Spindle 23 is accurately positionable to a desired angle by a sine bar mechanism. Specifically, a rotatable sine plate 32 is secured to spindle 23, being seated against a shoulder on spindle 23, adjacent body end face 20 (see FIG. 1). Plate 32 is secured on the spindle by a nut 33, and it is supported against deflection by facial sliding engagement with body end face 20, both above and below groove 30. Plate 32 is semicircular, of the same radius as body end face upper portion 29, and is centered with it. The rim of the plate has an index mark for indicating its angular position by reference to the scale. The angle of the plate 32, and hence of spindle 23, is set by the use of gauge blocks 46 which can be seated on a platform 45 that is removably seated in groove 30. For this purpose, cylindrical contact pins 34 and 35 are secured to plate 32 in such position that a line drawn through the centers of the two pins passes through central axis 18, about which plate 32 and spindle 23 rotate. The pins are alternately engageable with the gauge blocks 46 which can be positioned on either side of center. The flat platform element 45 is snugly seatable in groove 30, so that it projects outwardly as a cantilevered beam (to the right, in FIG. 1) from the body end face 20, and it provides a flat known mounting surface upon which the stack of one or more gauge blocks 46 can be placed. By selecting gauge blocks to provide an upper surface 47 of calculated height above the plane passing through axis 18, and given the radial dimension between axis 18 and the center of the respective pin 34 or 35, the sine of the subtended angle is defined. The spindle is set at that angle by turning plate 32 until the contact pin abuts the top of the gauge blocks.

With reference to FIG. 3, it will be noted that the removability of platform 45 makes it possible to set angles on both sides of center. Thus, in FIG. 3, block 45 is shown as seated in groove 30 on the right side of center, with the result that the wheel dressing tip is angulated on the other side of center; similarly, by inserting platform block 45 in the groove on the left side of center, the tip is set on the opposite side. Once a desired angle has been set, spindle 23 can be locked at that angle by tightening screw 37.

The dressing tip itself is positioned at the opposite end of body 10 from the sine bar mechanism, i.e., at the left end as seen in FIG. 1. In the embodiment shown, this tip comprises a diamond 55, mounted at the end of a carrier 56 which projects transversely to a longitudinally reciprocable slide or shaft 57. The carrier is secured to slide 57 by a screw, as at 59, so that it can be shifted from side to side.

The angular position of slide 57 is controlled by the angular position of spindle 23, which is in turn controlled by the position to which the sine bar plate is set; the longitudinal movement of slide 57 and tip 55 at this angle is controlled by rotation of operating shaft 25, through mechanism now to be described.

A head in the form of an arm 60 is secured to or formed integrally with spindle 23, having one face bearing slidably against body end face 19. Head 60 has an overhanging portion 61 which presents a bore 62 that is radial to axis 18. Slide 57 is received in this bore 62 and is both slidable along the bore and rotatable in the bore.

On the opposite side of body axis 18 from head portion 61, a finger 66 projects radially from the head, and presents opposite side faces 67 and 68 (see FIG. 2). A pair of adjustably positionable stops 70 and 71, which can slide in a track 72 in the body, limit the rotation of the head as they alternately come to bear on the respective side faces 67 and 68 of finger 66. Once sine plate 32 has first been positioned at a desired angle, stop pin 70 or 71 can be slid along track 72 and locked at the position in which the respective pin abuts the finger; the other pin is used similarly, for angle settings on the other side of center. Thereafter, the stops will function as quick setting means for indexing the head to two previously set angles. The stop track 72 comprises a circular T-slot milled into body end face 19, centered on axis 18, and having an entrance at 73 for insertion of the stop pins. Each stop has an inner end 74 which is seated within the enlarged head of T-slot 73, and includes a set screw for locking it.

Next will be described the mechanism for reciprocating slide 57 radially to axis 18. Operating shaft 25 is connected to slide 57 by a crank mechanism generally at 77, for reciprocating the slide. The mechanism 77 includes an eccentric 78 which is affixed to shaft 25 to rotate eccentrically as that shaft is turned by manual operation of knob 51. Pin 78 is coupled to slide 57 through a connecting rod 80, having a journal 81 at one end in which the pin 78 is pivoted. At its opposite end, connecting rod 80 is secured to slide 57 through a ball and socket type universal joint (see FIG. 4.). A ball 82 is received in a counterbore 83 in the slide, and is retained therein by a threaded ring 84. The ring holds the ball within the socket 83 and prevents longitudinal movement of the ball with respect to the slide. Thus, as shaft 25 is turned, its rotary motion is transformed into radial reciprocating motion if slide 57. Dressing tip carrier 56 moves with the slide, along a lineal path parallel to that of the radial line along which slide 57 moves.

The slide 57 is not only reciprocable within head arm 60, it is also rotatable within bore 62. This rotatability permits the slide, and tool carrier 56 attached to it, to be swung 180° so as to project in the opposite direction from the slide. The slide is held alternately in the two 180° apart positions by a sliding detent mechanism shown in FIG. 5. On its opposite sides, slide 57 has longitudinally extending grooves 87 and 88. An L-shaped detent arm 89 is slidable in a cross bore in head 60 and includes a detent tip 90 which is slidingly received in the respective groove 87 or 88. A spring 91 is seated in the head and biases the detent arm 89 and tip 90 toward a position of engagement with the respective groove. By pushing arm 89 to the right, as seen in FIG. 5, the detent tip is disengaged from slide 57 so that the slide is freed to be turned about its axis, thereby to change the orientation of the tool carrier. It will be seen that the previously described ball and socket joint between connecting rod 80 and slide 57 permits this rotation. While it is contemplated that a rack and pinion could alternatively be used to convert rotary motion of shaft 25 to linear movement of slide 57, it will be appreciated that that would limit the desirable reversibility of the carrier. A cap 93 is secured onto the head to enclose the reciprocating mechanism.

The operation of the device can now be explained. Referring to FIG. 3, body 10 is seated on mounting face 12 on a magnetic chuck, not shown, and is to be set to dress bevels on two faces of a grinding wheel 94. Sine bar plate 32 is first positioned with gauge blocks so that head 60 is set on one side of center, to one of the desired two angular positions. The stop 70 is slid to abut the finger 66 at that position, and is locked in place. The gauge block positioning platform 45 is removed from groove 30, plate 32 is rotated to expose the groove on the other side of center, and platform 45 is reseated in the groove there. the same stack of blocks (or a stack of different height, to set a different angle) is set on the platform, plate 32 turned to abut it, and the stop 71 locked against the finger. The two angles are thus set, and the head thereafter can be set at either ot them merely by swinging it to abut the stop, with screw 37 loosened.

With carrier 56 projecting toward wheel 94, unidirectional rotation of operating knob 51 causes the dressing tip 55 to move as indicated by the arrows, to dress one beveled face of the grinder to the precisely established angle. By releasing screw 37 and swinging head 60 so that finger 66 is engaged with the other stop 70 or 71, the head is brought to a position on the opposite side of center, for example as shown in phantom lines in FIG. 3. This ease of angle indexing facilitates dressing the opposite bevel of the grinding wheel. As previously indicated, the device can be used to form a complementary angle, without resetting spindle 23, merely by turning body block 10 to a second face. Thus, by reseating the device on face 13, and reversing slide 57 by 180°, tip 55 is presented for grinding the beveled face on a grinding wheel 95 to an angle which is the complement of the angle to which the wheel 94 was cut. No part of the device projects beyond the plane of face 11 or 13, to impede such remounting.

From the foregoing it can be appreciated that this device is readily mountable, accurately settable to any desired angle, and operable to quickly and precisely dress a wheel to that angle. The head is facially supported by the body, so that deflection under load on the tip is minimal.

Having described the invention, what is claimed is:

1. A device for dressing a grinding wheel, said device comprising a body in the form of a block presenting first and second planar mounting faces, said faces being perpendicular one to the other, and each of said faces being adapted to lie flush on a planar support surface in use, a head mounted at one end of said body for selective rotation on an axis parallel to said perpendicular mounting faces, the angular position of said head relative to said body being adjustable by turning said head about said axis, a dressing tool mounted on said head for reciprocal sliding movement relative to said head, said dressing tool being adapted to reciprocate in a linear path that is parallel to a linear path radially extending from said axis, sine bar means connected to said head, said sine bar means being adapted to accurately set the angulation of said head at a first angle with respect to said first mounting face and at a second angle with respect to said second mounting face, said sine bar means including a platform removably seatable in a groove in an opposite end of said body to project therefrom as a cantilever parallel to said axis, and a rotatable plate angularly positioned by abutment with gauge blocks when the latter are stacked on said platform, lock means for fixing said head to said body at that desired angular position as set by said sine bar means, and means for moving said dressing tool along said linear path, said linear path determining said first angle when said body rests on said first face and said linear path determining said second angle when said body rests on said second face, thereby providing a dressing device for a grinding wheel adapted to establish two grinding angles with a single setting of said sine bar means.

2. The device of claim 1 wherein said groove runs across said opposite end, parallel to the plane of one of said faces, and said plate is semicircular and rotatable across said groove.

3. The device of claim 1 wherein said head is carried by a spindle extending through said body, said rotatable plate being secured to said spindle at said opposite end of said body.

4. The device of claim 1 which further includes adjustable stops settable by said sine bar means and engageable with said head to position the latter at desired angles.

5. The device of claim 1 wherein said dressing tool comprises a shaft and said shaft is slidably mounted to said head for reciprocating movement with respect to the latter.

6. The device of claim 1 wherein said dressing tool is moved, by operation of the moving means, in a plane which is perpendicular to the said mounting faces of said body.

7. The device of claim 1 further wherein said dressing tool is selectively rotatable relative to said linear path to select that use position desired, and including latch means adapted to restrain said tool in a desired use position.

8. The device of claim 7 wherein said latch means comprises a detent slidably engageable alternately in two opposite longitudinal grooves on said dressing tool.

9. A device for dressing a grinding wheel, said device comprising, a body in the form of a block presenting first and second planar mounting faces, said faces being perpendicular one to the other, and each of said faces being adapted to lie flush on a planar support surface in use, a head mounted at one end of said body for selective rotation on an axis parallel to said perpendicular mounting faces, the angular position of said head relative to said body being adjustable by turning said head about said axis, a dressing tool mounted on said head for reciprocal sliding movement relative to said head, said dressing tool being adapted to reciprocate in a linear path that is parallel to a linear path radially extending from said axis, sine bar means connected to said head, said sine bar means being adapted to accurately set the angulation of said head at a first angle with respect to said first mounting face and at a second angle with respect to said second mounting face, lock means for fixing said head to said body at that desired angular position as set by said sine bar means, and means for moving said dressing tool along said linear path, said linear path determining said first angle when said body rests on said first face and said linear path determining said second angle when said body rests on said second face, thereby providing a dressing device for a grinding wheel adapted to establish two grinding angles with a single setting of said sine bar means, the means for moving said dressing tool including a slide connected to a crank mechanism and to said dressing tool, the crank mechanism including an operating shaft extending through said body coaxially with the axis, the crank having an eccentric which is connected by a connecting rod to said slide.

* * * * *